US007801470B2

(12) United States Patent
Minegishi et al.

(10) Patent No.: US 7,801,470 B2
(45) Date of Patent: Sep. 21, 2010

(54) DEVELOPING DEVICE, PROCESS UNIT, AND IMAGE FORMING APPARATUS

(75) Inventors: Natsuko Minegishi, Tokyo (JP); Seiko Itagaki, Tokyo (JP); Hiroshi Akita, Tokyo (JP)

(73) Assignee: Konica Minolta Business Technologies, Inc. (JP)

( * ) Notice: Subject to any disclaimer, the term of this patent is extended or adjusted under 35 U.S.C. 154(b) by 79 days.

(21) Appl. No.: 12/046,177

(22) Filed: Mar. 11, 2008

(65) Prior Publication Data

US 2008/0253811 A1 Oct. 16, 2008

(30) Foreign Application Priority Data

Apr. 16, 2007 (JP) ..... JP2007-106886

(51) Int. Cl.
*G03G 15/08* (2006.01)

(52) U.S. Cl. ..... 399/265; 399/55; 399/288

(58) Field of Classification Search ..... 399/50, 399/55, 265, 272, 278, 281, 288
See application file for complete search history.

(56) References Cited

U.S. PATENT DOCUMENTS 4,459,009 A * 7/1984 Hays et al. ..... 399/284
5,276,488 A * 1/1994 Schmidlin ..... 399/288
5,491,538 A * 2/1996 Gwaltney ..... 399/223
5,517,288 A * 5/1996 Martin et al. ..... 399/262
6,229,979 B1 * 5/2001 Ishii et al. ..... 399/281

FOREIGN PATENT DOCUMENTS

JP 6-102755 A 4/1994
JP 2005-221938 A 8/2005

* cited by examiner

*Primary Examiner*—David P Porta
*Assistant Examiner*—Benjamin Schmitt
(74) *Attorney, Agent, or Firm*—Cantor Colburn LLP

(57) ABSTRACT

A developing apparatus, comprises an endless belt shaped donor member; a developer supporting member to carry developer including toner and magnetic carrier and to form a toner layer on the donor member; a first supporting member arranged in the inside of the donor member with a predetermined gap against the developer supporting member and to strain the donor member; a second supporting member arranged in the inside of the donor member with a predetermined gap against the developer supporting member and to strain the donor member; a toner supply bias applying section to apply onto the first supporting member a toner supply bias for supplying toner from the developer supporting member to the donor member; and a toner recovery bias applying section to apply onto the second supporting member a toner recovery bias for recovering toner from the donor member to the developer supporting member.

15 Claims, 7 Drawing Sheets

DEVELOPING DEVICE, PROCESS UNIT, AND IMAGE FORMING APPARATUS

CROSS-REFERENCE TO RELATED APPLICATION

This application is based on Japanese Patent Application No. 2007-106886 filed on Apr. 16, 2007, in Japanese Patent Office, the entire content of which is hereby incorporated by reference.

BACKGROUND OF THE INVENTION

The present invention relates to a development technology in an electrophotography process, especially the development technology of a hybrid developing method.

The hybrid developing method is a developing method which supplies toner to a donor member from developer which includes toner and carrier, forms a toner layer on the donor member, conveys toner to a developing area by the donor member, and develops a latent image with the toner on the donor member. As a result that the development is performed with toner having a uniform electrically charged amount, the hybrid developing method has the following excellent features that fogging caused by weakly electrically-charged toner or reversely electrically-charged toner can be refrained, there is no carrier adhesion, and so on.

The hybrid developing method is disclosed in Patent documents 1 and 2 as explained below.

Patent document 1 discloses a developing device in which a toner supplying function and a toner recovering function are separated by one magnetic brush made opposite and two electrodes provided inside of a donor belt. Patent document 2 discloses a developing device which comprises a drum-shaped donor member, a supply magnet roller to supply toner to the donor member, and a recovery magnet roller to recover toner from the donor member, and conveys developer from the supply magnet roller to the recovery magnet roller.

Patent documents 1: Japanese Patent Unexamined Publication No. 6-102755

Patent documents 2: Japanese Patent Unexamined Publication No. 2005-221938

There are the following problems in the above technology.

In Patent document 1, electrodes provided in a donor belt do not support the donor belt itself. Specifically, these electrodes are electrically conductive brush, and the gap between magnetic brush and the donor member at both of a toner feed section and a toner recovering section fluctuate easily. For this reason, the supply electric field and the recovery electric field formed between the donor member and the magnetic brush fluctuate, and the amount of toner on the donor member becomes uneven. As a result, uneven development may take place easily. Moreover, since toner may not be completely recovered from the donor member, a memory effect occurs easily.

In Patent documents 2, the flow of developer is formed from a supply magnet roller to a recovery magnet roller. In the case where the flow of developer is formed in such the way, a path to return developer from a recovery magnet roller to a supply magnet roller is needed as a circulation path of the developer. Therefore, there are problems that the structure of the developing device becomes complicated, and a developing device becomes large size.

SUMMARY OF THE INVENTION

An object of the present invention is to solve the above problems in prior art regarding the hybrid developing and to realize a developing apparatus which can form a high quality image with a uniform image density stably and is downsized.

The above object can be attained by the following structure.

A developing apparatus for forming a toner image on an image carrying member via a donor member, comprises:

the donor member structured in an endless belt shape;

a developer supporting member to carry developer including toner and magnetic carrier and to form a toner layer on the donor member;

a first supporting member arranged in the inside of the donor member with a predetermined gap against the developer supporting member and to strain the donor member;

a second supporting member arranged in the inside of the donor member with a predetermined gap against the developer supporting member and to strain the donor member;

a toner supply bias applying section to apply onto the first supporting member a toner supply bias for supplying toner from the developer supporting member to the donor member; and a toner recovery bias applying section to apply onto the second supporting member a toner recovery bias for recovering toner from the donor member to the developer supporting member.

DETAILED DESCRIPTION OF THE PREFERRED EMBODIMENTS

While some preferred embodiments of the present invention are described below, the present invention shall not be limited to these embodiments.

Embodiment 1

Figure 1:
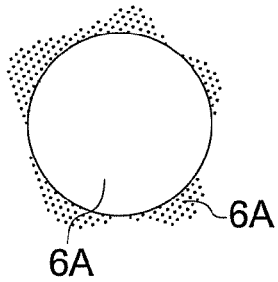
FIG. 1(*a*) and FIG. 1(*b*) are drawing showing a developing device according to Embodiment 1 of the present invention.
Figure 1:
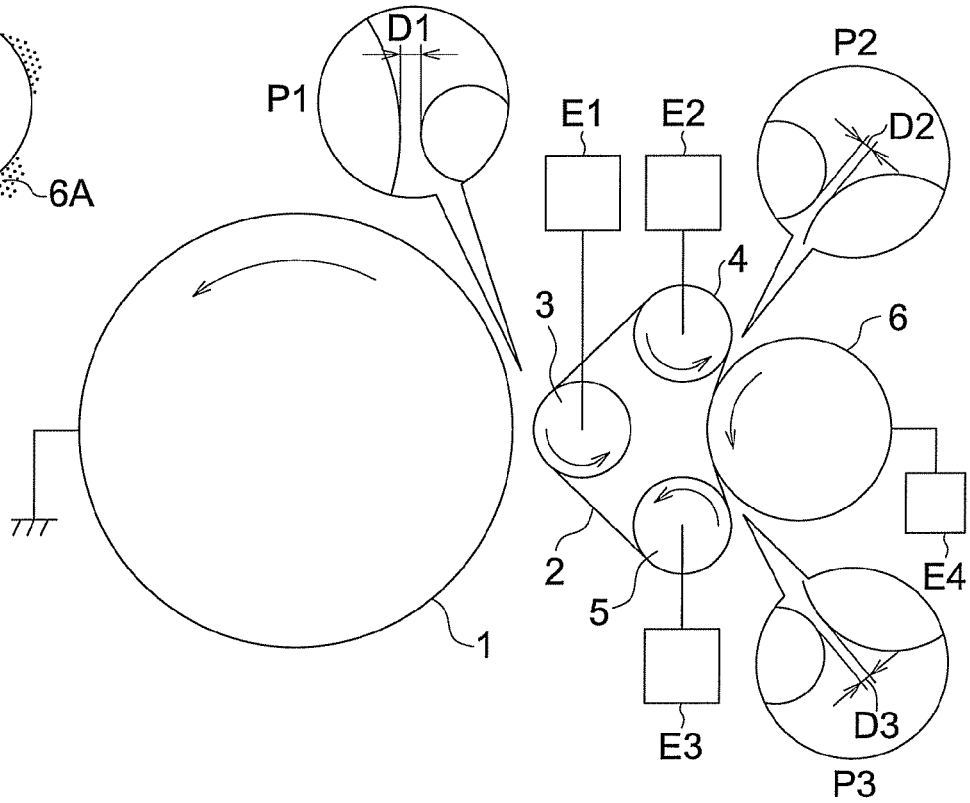

FIG. 1 is a drawing showing a developing device according to Embodiment 1.

Reference number 1 is a photoreceptor as an image carrying member which carries an electrostatic latent image formed by processes of electrically-charging and imagewise exposing. As the image carrying member, a well-known one such as an OPC photoreceptor and so on can be arbitrarily employed.

Reference number 2 is a donor member which is structured with a belt, and is semi-conductive.

Reference numbers 3 to 5 are rollers which support the donor member 2.

Reference number 6 is a magnet roll as a developer carrying section.

Reference number 3 is a roller as a third supporting member that makes the donor member 2 to oppose to the photoreceptor 1 at a development position P1, and a development gap (minimum distance) D1 between the surface of the photoreceptor 1 and the surface of the donor member 2 is set up by the roller 3.

Contact type development or non-contact type development is set up by the size of the development gap D1.

The contact type development is a development performed on the condition where a toner layer on the donor member 2 comes in contact with the surface of the photoreceptor 1, and the non-contact type development is a development performed on the condition where a toner layer on the donor member 2 does not come in contact with the surface of the photoreceptor 1.

A developing bias is applied to the roller 3 by a power source E1. The power source E1 applies a bias voltage to form an electric field to move electrically-charged toner to the photoreceptor 1 from the donor member 2, and applies as the bias voltage a direct current voltage or a voltage in which an alternating current voltage is superimposed on a direct current voltage.

A roller 4 as a first supporting section supports the donor member 2 at a toner supply position P2, and forms a toner supply gap D2 between the surface of the donor member 2 and a magnet roll 6. A bias voltage as a toner supply bias is applied to the roller 4 by a power source E2 (toner supply bias applying section).

A roller 5 as a second supporting member supports the donor member 2 at a toner recovery position P3, and forms a toner recovery gap D3 between the surface of the donor member 2 and the magnet roll 6. A toner recovery bias voltage is applied to the roller 5 by a power source E3 (toner recovery bias applying section).

The development gap D1 is the minimum distance (the shortest distance) between the surface of the photoreceptor 1 and the surface of the donor member 2, and this distance corresponds to the shortest distance between the surface of the photoreceptor 1 and the surface of the roller 3. Further, the toner supply gap D2 and the toner recovery gap D3 are the minimum distances between the surface of a magnet roller 6A of the magnet roll 6 and the surface of the opposed donor member 2. Namely, since the belt-shaped donor member 2 is supported by the surface of the roller 4 and the surface of the roller 5 at these positions, the toner supply gap D2 and the toner recovery gap D3 correspond to the minimum distance between the surface of the magnet roll 6 and respective surfaces of the roller 4 and roller 5.

In this embodiment, a reversal development which develops a latent image formed with negative electric charge by the use of negative electrically-charged toner is performed.

The power source E1 applies a bias voltage which is a negative direct current voltage or a negative direct current voltage superimposed with an alternating current voltage so as to form an electric field between the grounded photoreceptor 1 and the donor member 2 in order to shift negative electrically-charged toner to the photoreceptor 1.

The power source E2 applies to the magnet roll 6 a relatively positive direct current voltage or a voltage in which an alternating current voltage is superimposed on a positive direct current voltage, and forms an electric field between the magnet roll 6 and the donor member 2 in order to shift negative electrically-charged toner to the donor member 2.

The power source E3 applies a relatively negative voltage to the magnet roll 6, and shifts negative electrically-charged toner from the donor member 2 to the magnet roll 6.

The power source E4 is a power source which applies a voltage to the magnet roll 6.

The magnet roll 6 is a roll on the circumferential surface of which a plurality of magnetic poles are formed, and as shown in FIG. 1(*b*), magnetic brush 6A of developer including toner and carrier is formed on the circumferential surface by the magnetic poles.

The photoreceptor 1, the rollers 2 to 5, and the magnet roll 6 rotate in directions like arrows respectively.

At the toner supply position P2, toner in carrier moves to the donor member 2, and a uniform toner layer is formed on the donor member 2.

At the development position P1, an electrostatic latent image on the photoreceptor 1 is developed, and a toner image is formed on the photoreceptor 1.

At the toner recovery position P3, toner on the donor member 5 is recovered to developer on a magnet roll 6.

At the toner supply position P2, the toner concentration of developer moving from the toner supply position P2 to the toner recovery position P3 decreases very much as a result of toner having shifted from the developer to the donor member 2.

At the toner recovery position P3, toner recovery is performed with high efficiency by an effect of the bias voltage by the power source E3 and by an effect of the toner concentration decrease at the toner supply position P1.

Therefore, toner remaining on the donor member 2 after development is fully recovered at the toner recovery position P3.

With this, it becomes possible to prevent very well a memory phenomenon in which a history of a previous development process influences a next toner image.

In this way, at the toner supply position P2 and the toner recovery position P3, the donor member is supported by a surface of the roller 4 and a surface of the roller 5 respectively. Therefore, since a toner supply gap D1 and a toner recovery gap D2 are maintained at predetermined values respectively, constant electric fields are maintained at the toner supply position P2 and the toner recovery position P3, stable toner supply and toner recovery are performed, and uniform development can be realized.

Embodiment 2

Figure 2:
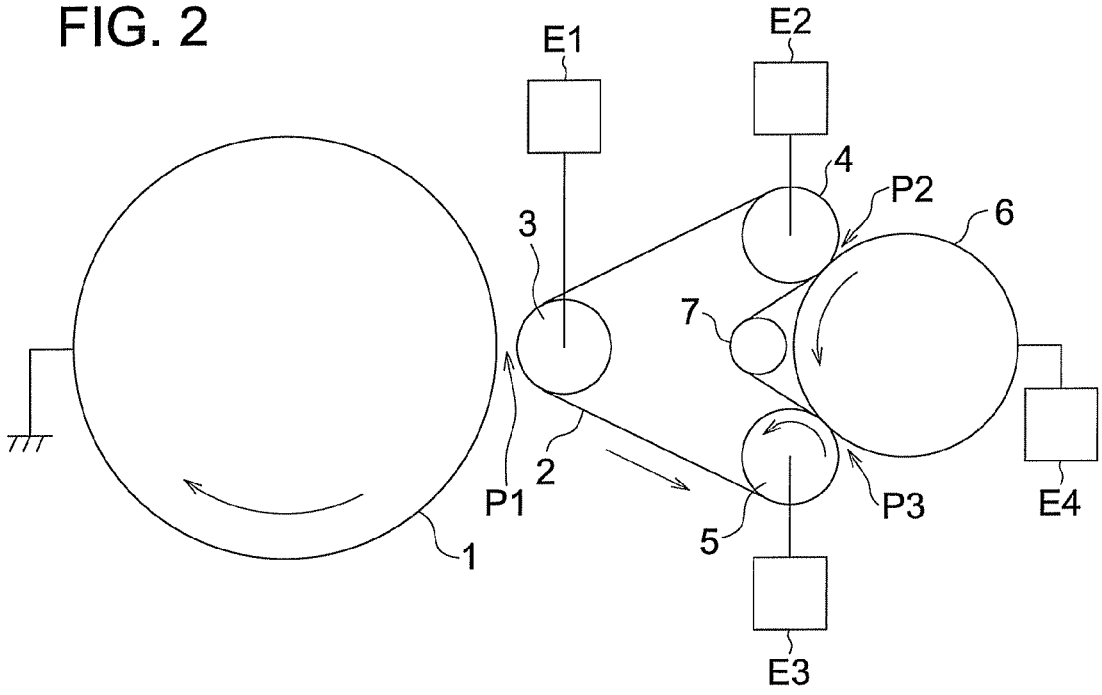
FIG. 2 is a drawing showing a developing device according to Embodiment 2 of the present invention.

FIG. 2 is a drawing showing a developing device according to Embodiment 2.

This embodiment has a structure that a spacing roller 7 as a spacing device is provide between rollers 4 and 5 so that the donor member 2 is separated from the magnet roll 6.

Developer is separated by the spacing roller 7 from the donor member 2 between the toner supply position P2 and the toner recovery position P3 so that stress added to the developer is reduced.

As a result, fatigue of developer, especially fatigue of carrier can be prevented.

The spacing roller 7 has a length in an axial direction almost equal to the rollers 4 and 5 and the magnet roll 6, and supports the donor member 7 overall its width.

Embodiment 3

Figure 3:
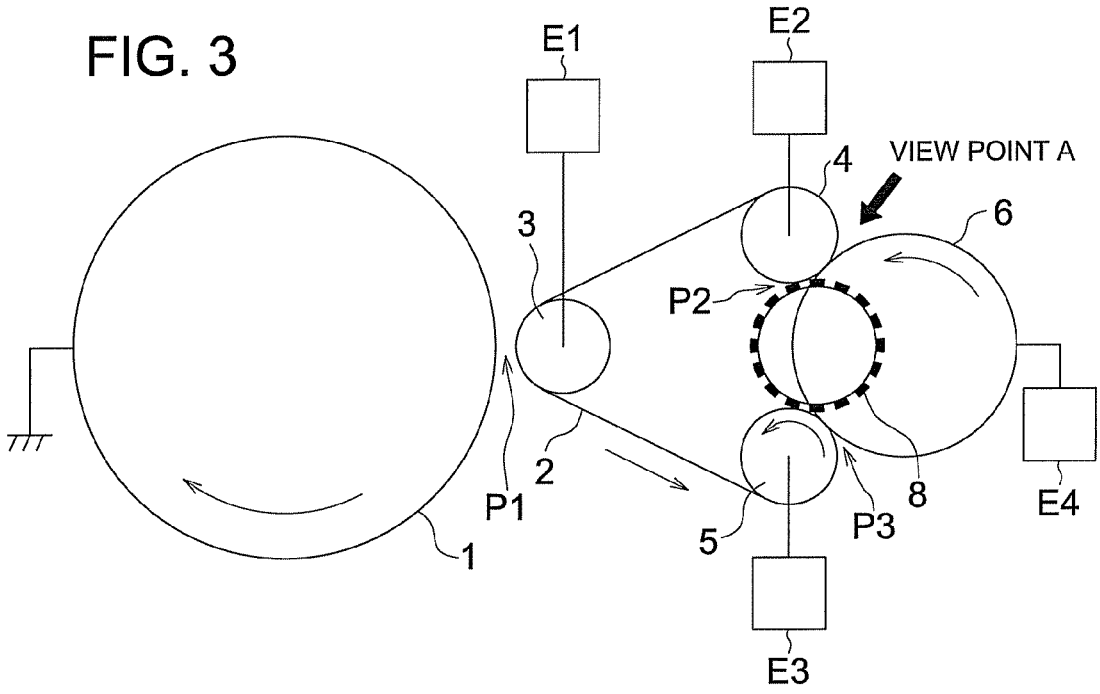
FIG. 3 is a front view of a developing device according to Embodiment 3 of the present invention.
Figure 4:
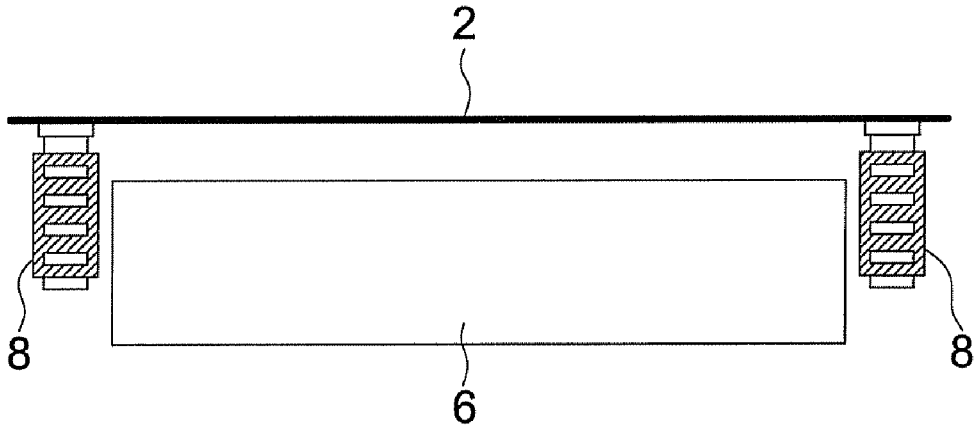
FIG. 4 is a side elevation view of a developing device according to Embodiment 3 of the present invention.

FIGS. 3 and 4 show a developing device according to Embodiment 3, FIG. 3 is a front sectional view and FIG. 4 is a side elevation view.

This embodiment has the structure where two spacing rings 8 are provided between rollers 4 and 5 so as to separate the donor member 2 from a magnet roll 6. The two spacing rings 8 support the donor member 2 at the ends of a shaft so as to separate the donor member 2 from a magnet roll 6.

Developer is separated from the donor member 2 between the toner supply position P2 and the toner recovery position P3 by the spacing ring 8, whereby stress added to the developer is reduced.

The spacing ring 8 has a large number of ribs similar to a gear, and supports the donor member 2 with the tip end of each rib.

Stress applied to un-recovery remaining toner on the donor member 2 is reduced by the spacing ring 8 having the large number of ribs, whereby deterioration of toner can be prevented.

Embodiment 4

Figure 5:
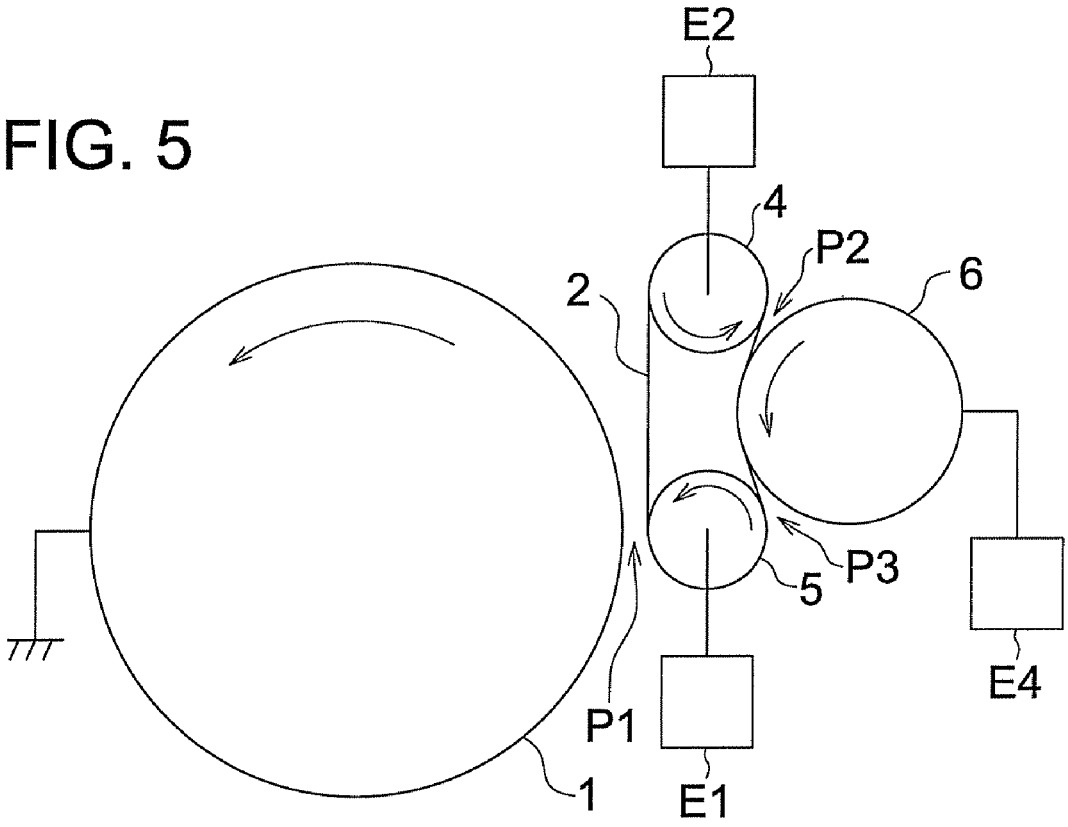
FIG. 5 is a drawing showing a developing device according to Embodiment 4 of the present invention.

FIG. 5 is a drawing showing a developing device according to Embodiment 4.

This embodiment has the structure where a predetermined development gap D1 (refer to FIG. 1) is formed between the photoreceptor 1 and the donor member 2 at the development position P1 by the roller 5, and a predetermined toner recovery gap D3 (refer to FIG. 1) is formed between the donor member 2 and the magnet roll 6 at the toner recovery position P3 by the same roller 5.

Since the development position P1 and the toner recovery position P3 are arranged at a near position to each other, this embodiment has the advantage that the developing device can be miniaturized.

By the setting of the applied voltage of the power source E1 such that the electric potential of the donor member 2 is higher than that of an exposure section of the photoreceptor 1 and also higher than that of magnet roll 6 (higher in absolute value), the development of an electrostatic latent image and the recovery of toner are performed very well.

Embodiment 5

Figure 6:
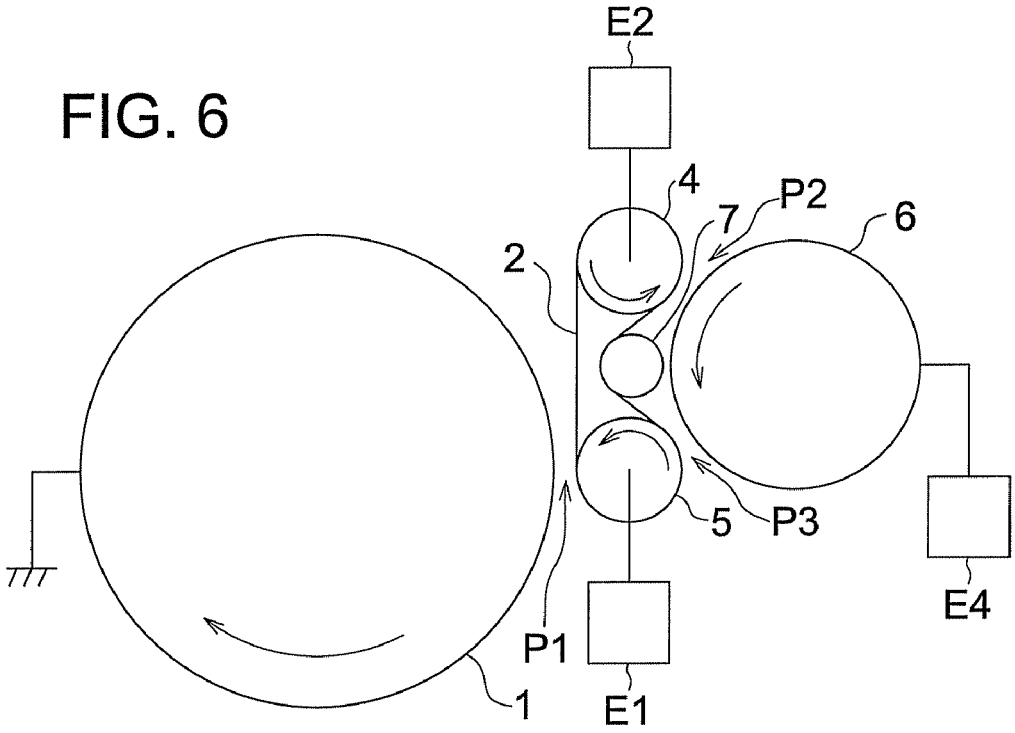
FIG. 6 is a drawing showing a developing device according to Embodiment 5 of the present invention.

FIG. 6 is a drawing showing a developing device according to Embodiment 5.

This embodiment is a modification of Embodiment 4 corresponding to Embodiment 2, and has a spacing roller 7 which separates the donor member 2 from the magnet roll 6 between the toner supply position P2 and the toner recovery position P3.

Embodiment 6

Figure 7:
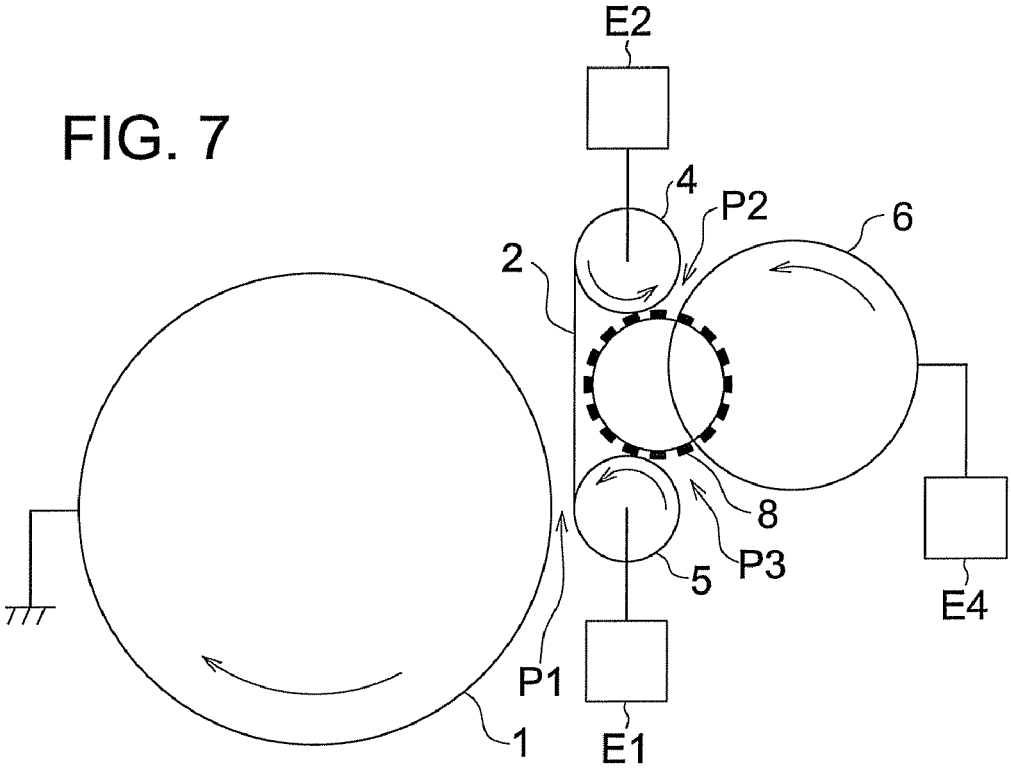
FIG. 7 is a drawing showing a developing device according to Embodiment 6 of the present invention.

FIG. 7 is a drawing showing a developing device according to Embodiment 6.

This embodiment is a modification of Embodiment 4 corresponding to Embodiment 3, and has a spacing ring 8 which separates the donor member 2 from the magnet roll 6 between the toner supply position P2 and the toner recovery position P3.

In the embodiments of the present invention explained above, at the toner supply position, since the first supporting member supports the donor member so as to maintain the toner supply gap uniformly, a toner layer is formed with a uniform thickness on the donor member, whereby uniform development is performed.

Moreover, when developer passes through the toner supply position, the toner concentration of the developer decrease. However, the toner is conveyed to a toner recovery position, and at the toner recovery position, since the second supporting member supports the donor member so as to maintain the toner recovery gap uniformly, the toner remaining after development is fully removed from the donor member, whereby a memory effect can be prevented.

Figure 8:
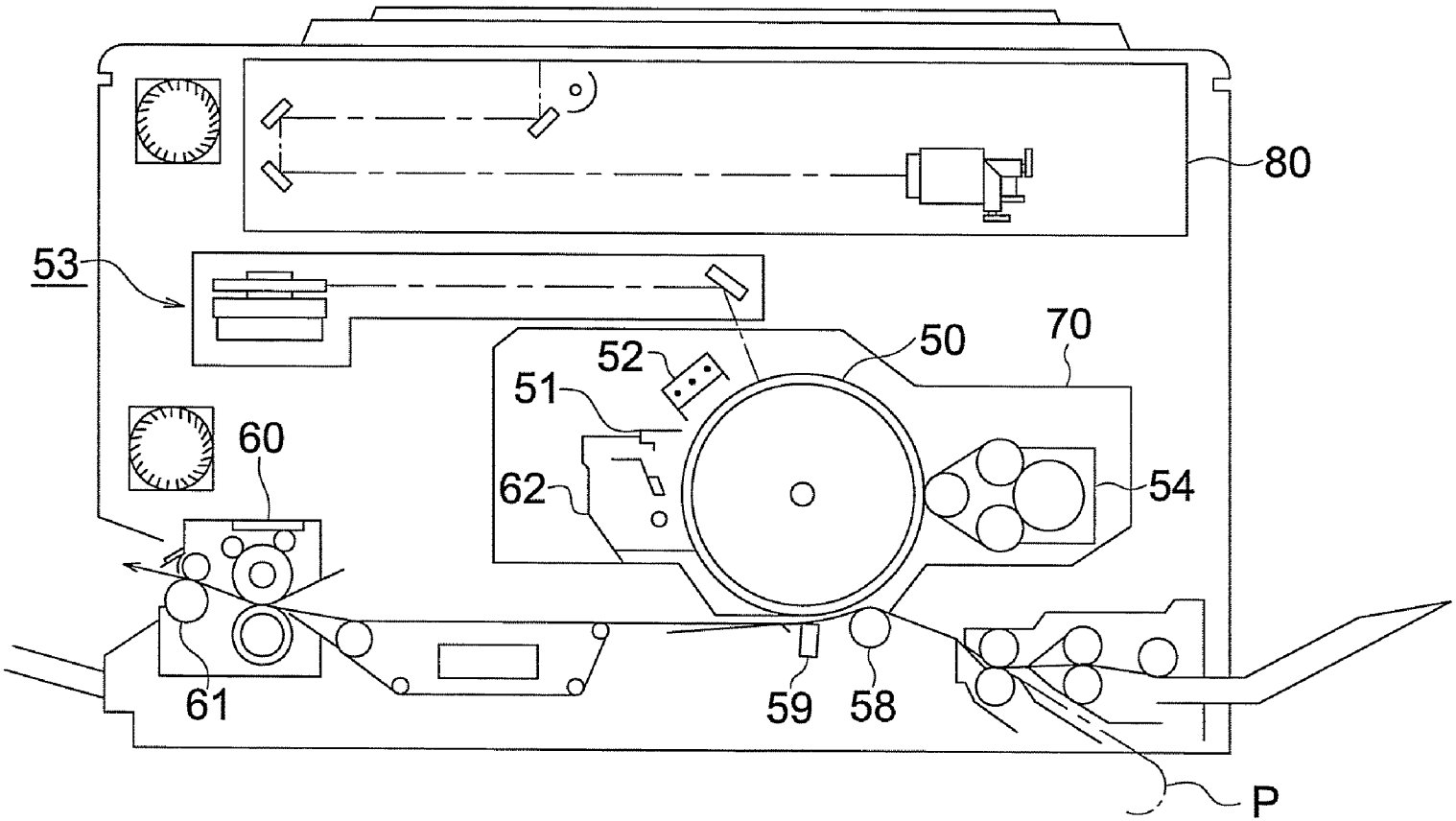
FIG. 8 is a drawing showing a developing device according to Embodiment of the present invention.

FIG. 8 shows a process cartridge which has a developing device according to the embodiments of the present invention and an image forming apparatus which has the process cartridge.

In FIG. 8, reference number 50 is a photoreceptor drum being an image carrying member, and the photoreceptor drum is a photoreceptor in which an organic photosensitive layer is coated on a drum, is grounded and rotated in the clockwise direction. Reference number 52 is a Scorotoron electrically-charging device which electrically-charges the photoreceptor drum uniformly by the corona discharging. In advance to the electrically-charging with this electrically-charging device 52, in order to eliminate a history of the photoreceptor in the previous image formation, exposure may be performed for the photoreceptor by an exposing section 51 which employs light emitting diode and the like. As a result, electric charge on the circumference surface of the photoreceptor is eliminated.

After the photoreceptor 50 is charged uniformly, image-wise exposure is performed for the photoreceptor 50 based on image signals by an image exposure device 53. The image exposure device 53 in this figure uses as an exposure light source a laser diode which is not illustrated. The photoreceptor 50 is scanned with a laser beam which enters into the photoreceptor drum 50 through a rotating polygon mirror, a fθ lens, and so on, whereby an electrostatic latent image is formed on the photoreceptor 50.

Subsequently, the electrostatic latent image is developed with a developing device 54. Then, a toner image is formed in a peripheral surface of the photoreceptor drum 50.

The developing device 54 conducts developing by hybrid development explained above.

After image formation, a recording sheet P is fed out to a transfer region by the rotational operation of the feed roller 57, when the transfer timing is ready.

In the transfer region, a transfer roller (transfer device) 58 is brought in pressure contact with the circumferential surface of the photoreceptor drum 50 in synchronization with the transfer timing, the fed-out recording sheet P is pressed between the photoreceptor drum 50 and the transfer roller 57, whereby a toner image is transferred onto the recording sheet P.

Subsequently, a separating brush (eliminator) 59 which is brought into pressure contact with the photoreceptor drum almost simultaneously with the transfer roller 57 eliminates charge on the recording sheet P, and separates the recording sheet P from the circumferential surface of the photoreceptor drum 50, and then the recording sheet P is conveyed to a fixing device 60.

In the fixing device 60, a toner is melted with heat and pressure, whereby a toner image is fixed on the recording sheet P.

The recording sheet P on which the toner image is fixed is discharged by a delivery roller 61.

On the other hand, after the recording sheet P is separated from the photoreceptor drum 50, the photoreceptor drum 50 passes through a cleaning device 62, whereby remaining toner is removed from the photoreceptor 50.

Reference number 70 is a process cartridge in which the photoreceptor 50, the electrically-charging device 52, the developing device 54, the transfer device 48, the eliminator 59, and the cleaning device are united into one body which can be detached and attached.

When the process cartridge 70 is pulled out in the direction toward the front side of the sheet of the drawing, the process cartridge 70 is taken out from the image forming apparatus.

Reference number 80 is a reading section to read a document.

Generally, the process cartridge includes an integral-type cartridge and a discrete-type cartridge. In the integral-type cartridge, at least one of an electrically-charging device, an image exposure device, a developing device, a transfer device, or an eliminator, and a cleaning device is constituted in one body with a photoreceptor so as to be detachably attached the apparatus body. In the discrete-type cartridge, at least one of an electrically-charging device, an image exposing device, a developing device, a transfer device or an eliminator and a cleaning devices which are structured as a separate body from a photoreceptor is formed in one body. These process cartridges can be attached detachably to an apparatus main body, and when these process cartridges are attached in the apparatus main body, they are united with a photoreceptor. The process cartridge in the present invention includes the both type cartridges stated above.

With the developing device and the image forming apparatus according to the embodiments of the present invention explained above, uniform development can be performed, whereby high quality image can be formed stably. In addition, the miniaturization of these device and apparatus becomes possible.

Example

Hereafter, an example and a comparative example are explained.

(1) Example

Structural Functional Conditions

With regard to Examples 1 to 3 using the developing device of Embodiment 1 to 3 shown in FIGS. 1-4, the developing device was operated on the following structural functional conditions so as to conduct developing.

<Developer>
Average toner particle size: 6.5 micrometers
Average carrier particle size: 33 micrometers
Toner concentration: 7.5 mass %
<Structure and Function of a Developing Device>
Toner conveyances amount of a donor member: 5 $g/m^2$
Toner conveyances amount of a magnet roll: 300 $g/m^2$
Photoreceptor: a drum-shaped OPC photoreceptor with a radius of 60 mm
Gap between a photoreceptor and a donor member: 0.15 mm
Gap between a donor member and a magnet-roll at a toner supply position: 0.31 mm
Gap between a donor member and a magnet roll at a toner recovery position: 0.31 mm
Photoreceptor rotational speed (linear velocity): 400 mm/s
Donor member shifting speed: 600 mm/s
Magnet roll rotational speed (linear velocity): 900 mm/s (The photoreceptor and the donor member moved in the same direction at the development position, and the donor member and the magnet roll moved in counter directions at the toner supply position and the toner recovery position.)

Examples 1-3 were conducted on the following electric potential conditions.

<Electric Potential Conditions>
Photoreceptor:
Electrically-charged potential V0: −450 V
Exposure electric potential Vi: −50 V
Bias voltage Vdc: −50 V at the toner supply position
(Power supply E2)
Vpp: 1.2 kV
Frequency: 2 kHz
Bias voltage Vdc: −320V at the development position
(Power supply E1)
Vpp: 1.2 kV
Frequency: 2 kHz
Bias voltage Vdc: −620V at the photoreceptor toner recovery position
(Power supply E3)
Vpp: 1.2 kV
Frequency: 2 kHz
Magnet-roll Potential Vdc: −500 V
(Power supply E4)

Example 4 using Embodiment 4 shown in FIG. 5 was conducted on the following electric potential conditions.

The structure and function of a developing device were as same as in Examples 1 to 3.

<Electric Potential Conditions>
Photoreceptor:
Electrically-charged potential V0: −650 V
Exposure electric potential Vi: −50 V
Bias voltage Vdc: −50 V at the toner supply position
(Power supply E2)
Vpp: 1.2 kV
Frequency: 2 kHz
Bias voltage Vdc: −520 V in development and recovery
(Power supply E1)
Vpp: 1.2 kV
Frequency: 2 kHz
Magnet-roll Potential Vdc: −400 V
(Power supply E4)
Vdc: direct-current potential
Vpp: peak to peak voltage of alternating voltage
Wave of alternating voltage: Square wave

(2) Comparative Example

Figure 9:
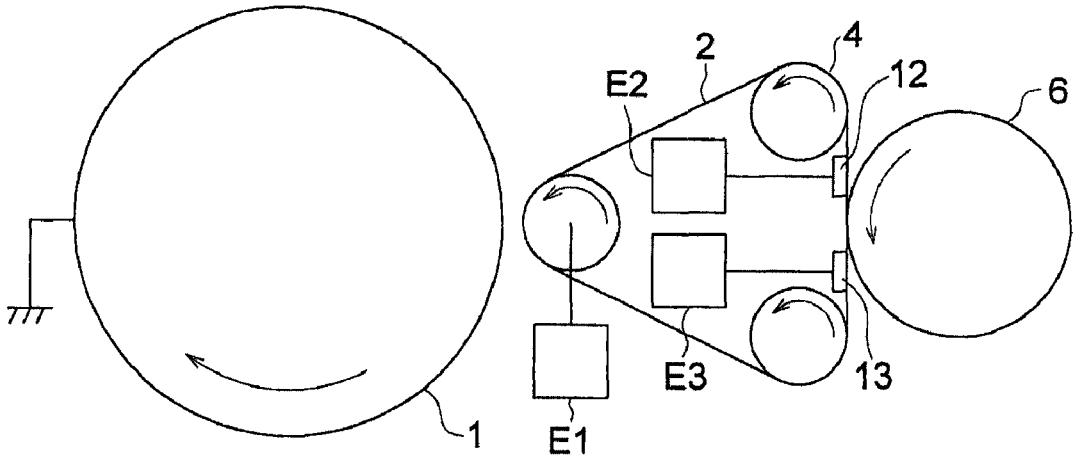
FIG. 9 PRIOR ART
FIG. 9 is a drawing showing a developing device used in Comparative example.

In Comparative example, an image was formed by the use of the developing device having the structure shown in FIG. 9.

In FIG. 9, a donor member 2 locating opposite to a magnet roll 6 is backed up with electrodes 12 and 13.

The position of the electrode 12 forms the toner supply position to supplies toner from a magnet roll 6 to the donor member 2, and the electrode 13 forms the toner recovery position to recover toner from the donor member 2 to a brush structural member 6.

Developer is the same as that of Example 1.

<Electric Potential Conditions>
Photoreceptor:
Electrically-charged potential V0: −450 V
Exposure electric potential Vi: −50 V
Bias voltage at the toner supply position (voltage applied to the electrode 12)
Vdc: −50 V Vpp: 1.2 kV
Frequency: 2 kHz (square wave)
Bias voltage at the development position
Vdc: −320 V
Vpp: 1.2 kV
Frequency: 2 kHz (square wave)
Bias voltage at the toner recovery position (voltage applied to the electrode 13):
Vdc: −620 V
Vpp: 1.2 kV
Frequency: 2 kHz (square wave)
Electric potential of the magnet roll 6
Vdc: −500 V (3) Evaluation Memory generating situations were evaluated by the following procedures.

Figure 10:
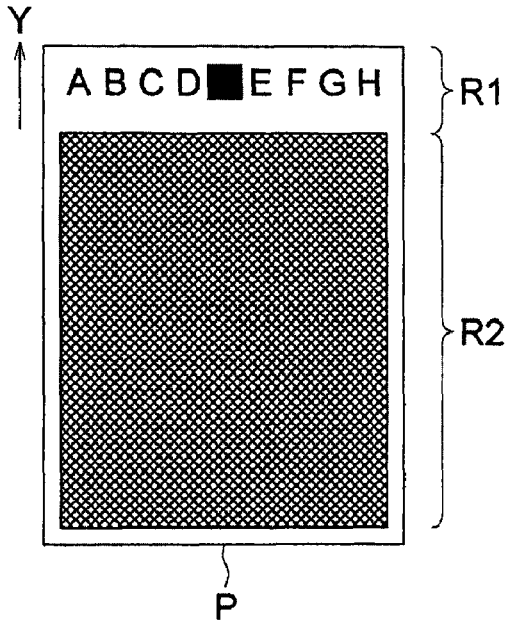
FIG. 10(*a*) and FIG. 10(*b*) are illustration showing images used for evaluation.
Figure 10:
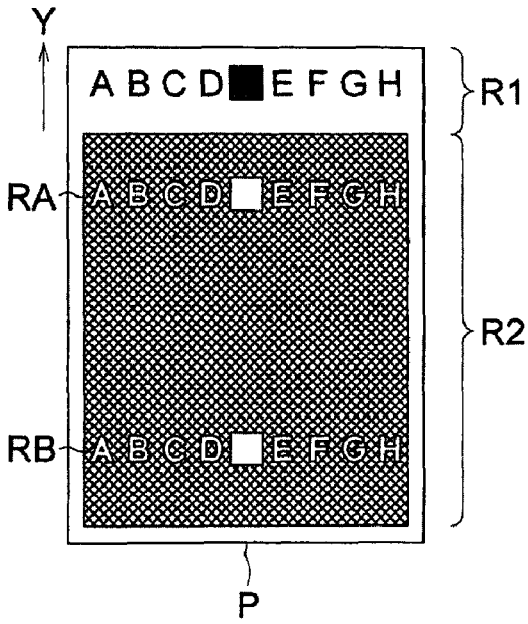

Recording sheet P of A3 size was conveyed in the direction of Y, and images shown in FIG. 10 was formed on it.

In FIG. 10, character images A to H and a square image (black) which were solid images were formed on a region R1 and a halftone image of a uniform image density was formed on a region R2.

When there was no memory effect, the image shown in FIG. 10 (*a*) was formed, but when there was a memory effect, as shown in FIG. 10 (*b*), the reverse images of the images of A-H and the black square on the region R1, in other words, whitened images of the characters of A-H and the square appeared on the region R2 by the memory effect.

In the image area RA in FIG. 10 (*b*), the density difference between the middle image density of the background and the whitened images was large, and in the image area RB, the density difference was small.

This phenomenon was due to the reason that after the donor member has circled one time, a memory effect decrease.

Evaluation results for images by visual observation are shown in Table 1.

TABLE 1

| Example 1 | Example 2 | Example 3 | Example 4 | Comp. Example |
|---|---|---|---|---|
| A | A | A | A | C |

A: Image was excellent.
C: Image failure occurred due to memory phenomena.

As shown in Table 1, uniform halftone images were formed in each of Examples 1 to 4, but in Comparative uneven density images were formed due to memory effect.

<Developer Deterioration Test>

Under the high temperature and high humidity environment where the deterioration of developer occurs rapidly, an image formation was conducted and the electrically charged amount of toner was measured.

Figure 11:
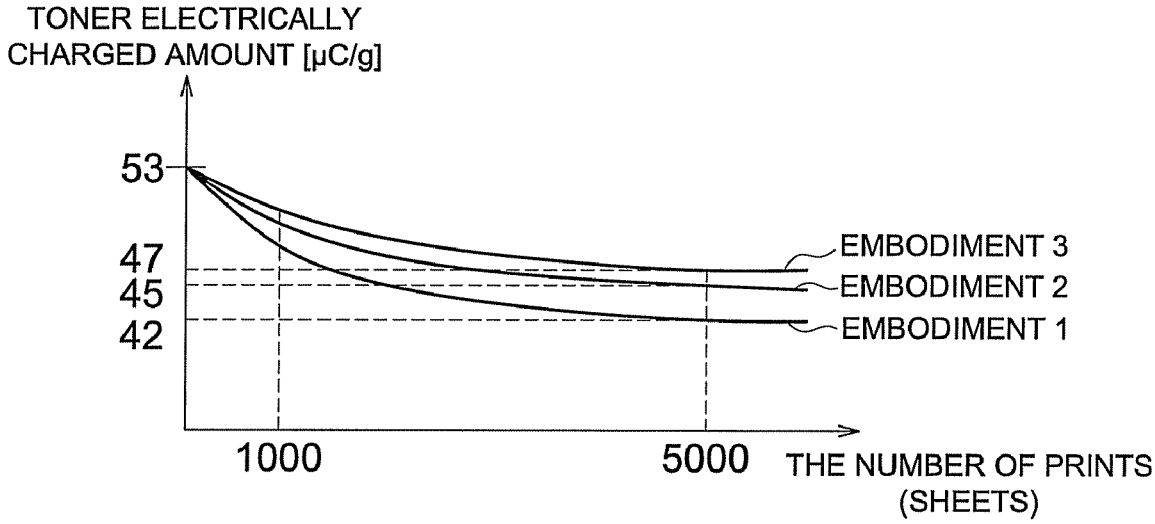
FIG. 11 is a drawing showing change in electrically charged amount.

Test results are shown in FIG. 11.

As recognized clearly from FIG. 11, in Embodiments 2 and 3 in which the donor member 2 was separated from the magnet roll 6 between the toner supply position P2 and the toner recovery position P3, the grade of an electrically charged amount reduction of toner is small, and the progress of the deterioration of developer was refrained.

In Embodiment 1 in which the donor member 2 was not separated, it was observed that the grade of an electrically charged amount reduction of toner is large, and the progress of the deterioration of developer was slightly rapid.

What is claimed is:

1. A developing apparatus for forming a toner image on an image carrying member via a donor member, comprising:

the donor member structured in an endless belt shape and arranged to face the image carrying member so that a developing region with a developing gap is formed between the donor member and the image carrying member;

a developer supporting member to carry developer including toner and magnetic carrier and to form a toner layer on the donor member;

a first supporting member arranged in the inside of the donor member with a predetermined gap against the developer supporting member;

a second supporting member arranged in the inside of the donor member with a predetermined gap against the developer supporting member;

a toner supply bias applying section to apply onto the first supporting member a toner supply bias for supplying toner from the developer supporting member to the donor member;

a toner recovery bias applying section to apply onto the second supporting member a toner recovery bias for recovering toner from the donor member to the developer supporting member; and a separating member to separate the donor member from the developer supporting member, being arranged between a toner supply position where toner is supplied from the developer supporting member to the donor member and a toner recovery position where toner is recovered from the donor member to the developer supporting member;

wherein the donor member is wound around the first supporting member and the second supporting member such that a toner supply gap is formed between the developer supporting member and the donor member at a position on the first supporting member and a toner recovery gap is formed between the developer supporting member and the donor member at a position on the second supporting member.

2. The developing apparatus of claim 1, wherein the separating member supports overall the entire width of the donor member so as to separate the donor member from the developer supporting member.

3. The developing apparatus of claim 2, wherein the separating member is a separating roller to support overall the entire width of the donor member.

4. The developing apparatus of claim 1, wherein the separating member supports the donor member at both end portions of the width of the donor member.

5. The developing apparatus of claim 4, wherein the separating member is a pair of separating rings to support the both end portions of the width of the donor member.

6. The developing apparatus of claim 1, wherein the first supporting member and the second supporting member are structured with a roller respectively.

7. The developing apparatus of claim 1, wherein the donor member is supported with a surface of the first supporting member at a position where the first supporting member opposes to the developer supporting member and is further supported with a surface of the second supporting member at a position where the second supporting member opposes to the developer supporting member.

8. The developing apparatus of claim 1, further comprising:

a third supporting member to strain the donor member such that the donor member opposes to the image carrying member with a predetermined gap.

9. The developing apparatus of claim 8, wherein at least one of the first supporting member and the second supporting member is used as the third supporting member.

10. The developing apparatus of claim 8, wherein the third supporting member is structured with a roller.

11. The developing apparatus of claim 1, wherein the developer supporting member is structured with a single supporting member which passes around a toner supply position where the single supporting member opposes to the first supporting member and around a toner recovery position where the single supporting member opposes to the second supporting member.

12. The developing apparatus of claim 1, wherein the developer supporting member is structured with a single magnet roll.

13. A process unit, comprising:

the developing apparatus of claim 1.

14. A process unit, comprising:

the image carrying member; and the developing apparatus of claim 1.

15. An image forming apparatus, comprising:

the image carrying member; and the developing apparatus of claim 1.

* * * * *